US008162622B2

(12) United States Patent
Shoulders

(10) Patent No.: US 8,162,622 B2
(45) Date of Patent: Apr. 24, 2012

(54) COMPRESSOR SOUND SUPPRESSION

(75) Inventor: Stephen L. Shoulders, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 1320 days.

(21) Appl. No.: 11/813,767

(22) PCT Filed: Mar. 7, 2005

(86) PCT No.: PCT/US2005/007597

§ 371 (c)(1),
(2), (4) Date: Jul. 12, 2007

(87) PCT Pub. No.: WO2006/096179

PCT Pub. Date: Sep. 14, 2006

(65) Prior Publication Data

US 2008/0260546 A1 Oct. 23, 2008

(51) Int. Cl.
*F04B 39/00* (2006.01)

(52) U.S. Cl. ..... 417/295; 417/312; 418/159; 418/201.2; 418/270

(58) Field of Classification Search ..... 417/295, 417/312; 418/159, 201.1, 201.2, 270; 137/542
See application file for complete search history.

(56) References Cited

U.S. PATENT DOCUMENTS

| | | | | |
|---|---|---|---|---|
| 3,813,079 | A | 5/1974 | Baumann et al. | |
| 4,062,199 | A * | 12/1977 | Kasahara et al. | 62/197 |
| 4,411,592 | A | 10/1983 | Traver et al. | |
| 4,729,402 | A * | 3/1988 | Blass et al. | 137/514.5 |
| 5,137,439 | A * | 8/1992 | Lundin | 418/181 |
| 5,203,679 | A | 4/1993 | Yun et al. | |
| 5,208,429 | A * | 5/1993 | Field | 181/229 |
| 6,132,191 | A | 10/2000 | Hugenroth et al. | |
| 6,312,232 | B1 * | 11/2001 | Mori et al. | 417/297 |
| 7,429,167 | B2 * | 9/2008 | Bonear et al. | 418/55.1 |
| 7,568,898 | B2 * | 8/2009 | Shoulders | 418/201.2 |
| 2002/0012595 | A1 | 1/2002 | Kouno et al. | |

FOREIGN PATENT DOCUMENTS

| | | | |
|---|---|---|---|
| CN | 1235242 | A | 11/1999 |
| DE | 4007749 | A1 | 10/1990 |
| DE | 29511419 | U1 | 10/1995 |
| JP | 04265490 | A | 9/1992 |

OTHER PUBLICATIONS

English translation of Chinese Office Action for CN200580048983.5, dated Jun. 5, 2009.

EP Search Report for European Patent Application No. 05725002.9, dated Apr. 27, 2011.

* cited by examiner

*Primary Examiner* — Charles Freay
*Assistant Examiner* — Patrick Hamo
(74) *Attorney, Agent, or Firm* — Bachman & LaPointe, P.C.

(57) ABSTRACT

A compressor apparatus (20) has a housing (22) having first (53) and second (58) ports along a flowpath. One or more working elements (26; 28) cooperate with the housing (22) to define a compression path between suction (60) and discharge (62) locations along the flowpath. A check valve (70; 170; 270) has a valve element (72; 172; 272) mounted for movement between a first condition permitting downstream flow along the flowpath and a second condition blocking a reverse flow. The valve element includes a resonator (112; 174; 274).

18 Claims, 4 Drawing Sheets

COMPRESSOR SOUND SUPPRESSION

BACKGROUND OF THE INVENTION

The invention relates to compressors. More particularly, the invention relates to compressors having check valves.

Screw-type compressors are commonly used in air conditioning and refrigeration applications. In such a compressor, intermeshed male and female lobed rotors or screws are rotated about their axes to pump the working fluid (refrigerant) from a low pressure inlet end to a high pressure outlet end. During rotation, sequential lobes of the male rotor serve as pistons driving refrigerant downstream and compressing it within the space between an adjacent pair of female rotor lobes and the housing. Likewise sequential lobes of the female rotor produce compression of refrigerant within a space between an adjacent pair of male rotor lobes and the housing. The interlobe spaces of the male and female rotors in which compression occurs form compression pockets (alternatively described as male and female portions of a common compression pocket joined at a mesh zone). In one implementation, the male rotor is coaxial with an electric driving motor and is supported by bearings on inlet and outlet sides of its lobed working portion. There may be multiple female rotors engaged to a given male rotor.

When one of the interlobe spaces is exposed to an inlet port, the refrigerant enters the space essentially at suction pressure. As the rotors continue to rotate, at some point during the rotation the space is no longer in communication with the inlet port and the flow of refrigerant to the space is cut off. After the inlet port is closed, the refrigerant is compressed as the rotors continue to rotate. At some point during the rotation, each space intersects the associated outlet port and the closed compression process terminates. The inlet port and the outlet port may each be radial, axial, or a hybrid combination of an axial port and a radial port. The compression pocket opening and closing (particularly discharge port opening) are associated with pressure pulsations and resulting sound. Sound suppression has thus been an important consideration in compressor design. Many forms of compressor mufflers have been proposed.

Additionally, various transient conditions may tend to cause reverse flow through the compressor. For example, upon a power failure or other uncontrolled shutdown high pressure refrigerant will be left in the discharge plenum and downstream thereof in the refrigerant flowpath (e.g., in the muffler, oil separator, condenser, and the like). Such high pressure refrigerant will tend to flow backward through the rotors, reversing their direction of rotation. If rotation speed in the reverse direction is substantial, undesirable sound is generated. For some screw compressors, damage to mechanical components or internal housing surfaces can also occur. Accordingly, a one-way valve (a check valve) may be positioned along the flowpath to prevent the reverse flow. Other forms of compressor (e.g., scroll and reciprocating compressors) may include similar check valves.

SUMMARY OF THE INVENTION

A compressor apparatus has a housing having first and second ports along a flowpath. One or more working elements cooperate with the housing to define a compression path between suction and discharge locations along the flowpath. A check valve has a valve element having a first condition permitting downstream flow along the flowpath and a second condition blocking a reverse flow. The valve element includes a resonator.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
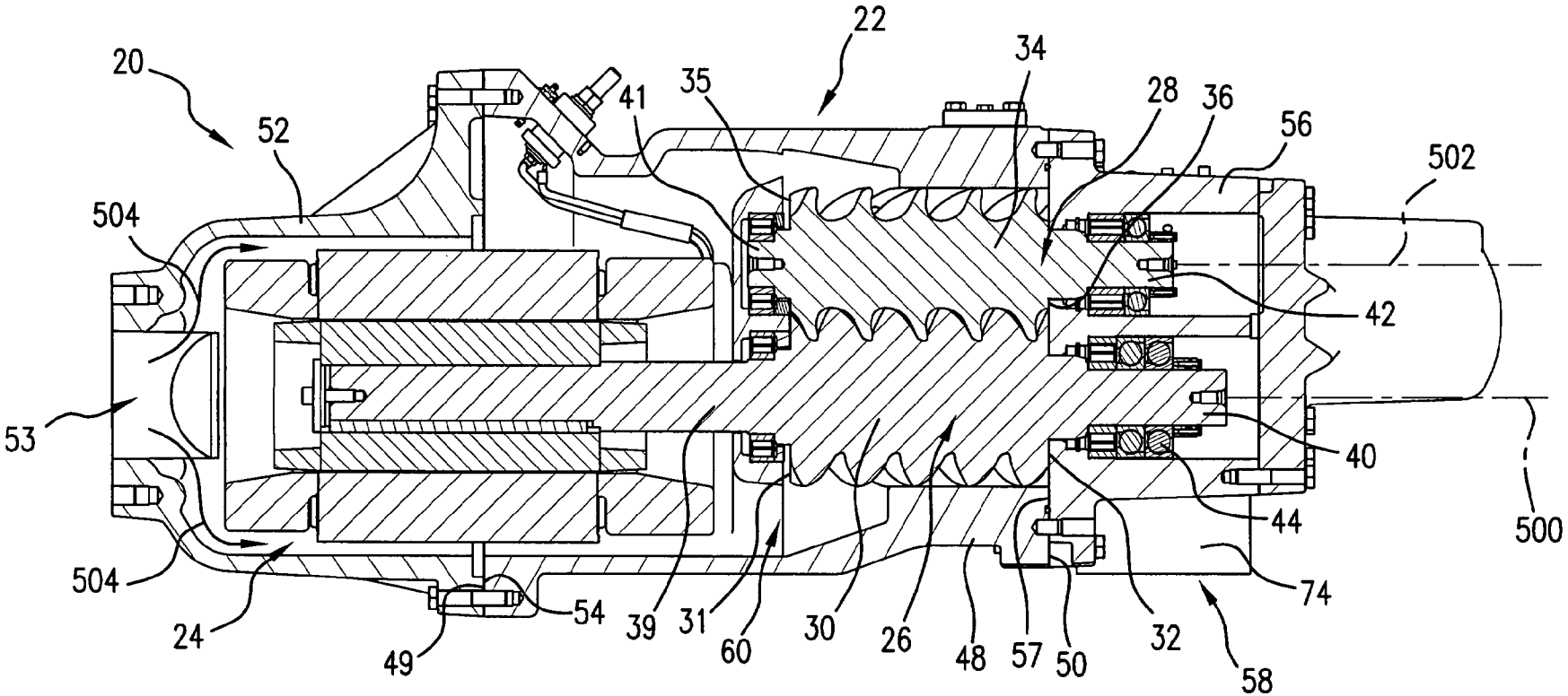
FIG. 1 is a longitudinal sectional view of a compressor.

FIG. 1 shows a compressor 20 having a housing assembly 22 containing a motor 24 driving rotors 26 and 28 having respective central longitudinal axes 500 and 502. In the exemplary embodiment, the rotor 26 has a male lobed body or working portion 30 extending between a first end 31 and a second end 32. The working portion 30 is enmeshed with a female lobed body or working portion 34 of the female rotor 28. The working portion 34 has a first end 35 and a second end 36. Each rotor includes shaft portions (e.g., stubs 39, 40, 41, and 42 unitarily formed with the associated working portion) extending from the first and second ends of the associated working portion. Each of these shaft stubs is mounted to the housing by one or more bearing assemblies 44 for rotation about the associated rotor axis.

In the exemplary embodiment, the motor is an electric motor having a rotor and a stator. One of the shaft stubs of one of the rotors 26 and 28 may be coupled to the motor's rotor so as to permit the motor to drive that rotor about its axis. When so driven in an operative first direction about the axis, the rotor drives the other rotor in an opposite second direction. The exemplary housing assembly 22 includes a rotor housing 48 having an upstream/inlet end face 49 approximately midway along the motor length and a downstream/discharge end face 50 essentially coplanar with the rotor body ends 32 and 36. Many other configurations are possible.

The exemplary housing assembly 22 further comprises a motor/inlet housing 52 having a compressor inlet/suction port 53 at an upstream end and having a downstream face 54 mounted to the rotor housing downstream face (e.g., by bolts through both housing pieces). The assembly 22 further includes an outlet/discharge housing 56 having an upstream face 57 mounted to the rotor housing downstream face and having an outlet/discharge port 58. The exemplary rotor housing, motor/inlet housing, and outlet housing 56 may each be formed as castings subject to further finish machining.

Figure 2:
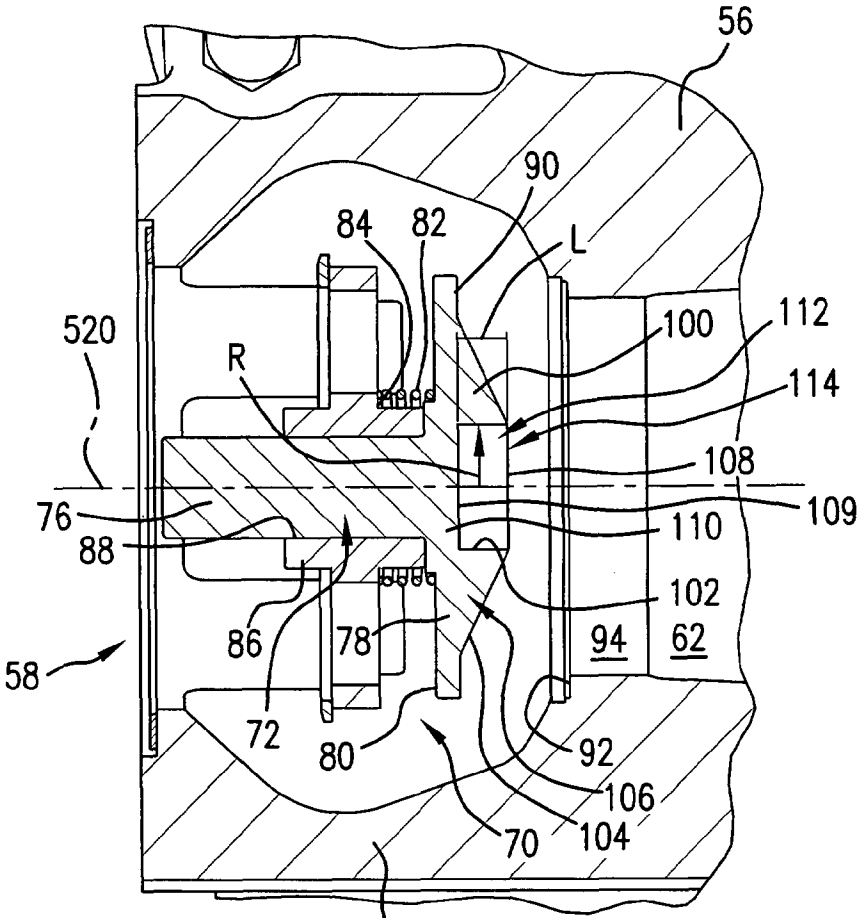
FIG. 2 is a partial sectional view of a discharge housing check valve of the compressor of FIG. 1 in a first condition.

Surfaces of the housing assembly 22 combine with the enmeshed rotor bodies 30 and 34 to define inlet and outlet ports to compression pockets compressing and driving a refrigerant flow 504 from a suction (inlet) plenum 60 to a discharge (outlet) plenum 62 (FIG. 2). A series of pairs of male and female compression pockets are formed by the housing assembly 22, male rotor body 30 and female rotor body 34. Each compression pocket is bounded by external surfaces of enmeshed rotors, by portions of cylindrical surfaces of male and female rotor bore surfaces in the rotor case and continuations thereof along a slide valve, and portions of face 57.

Figure 3:
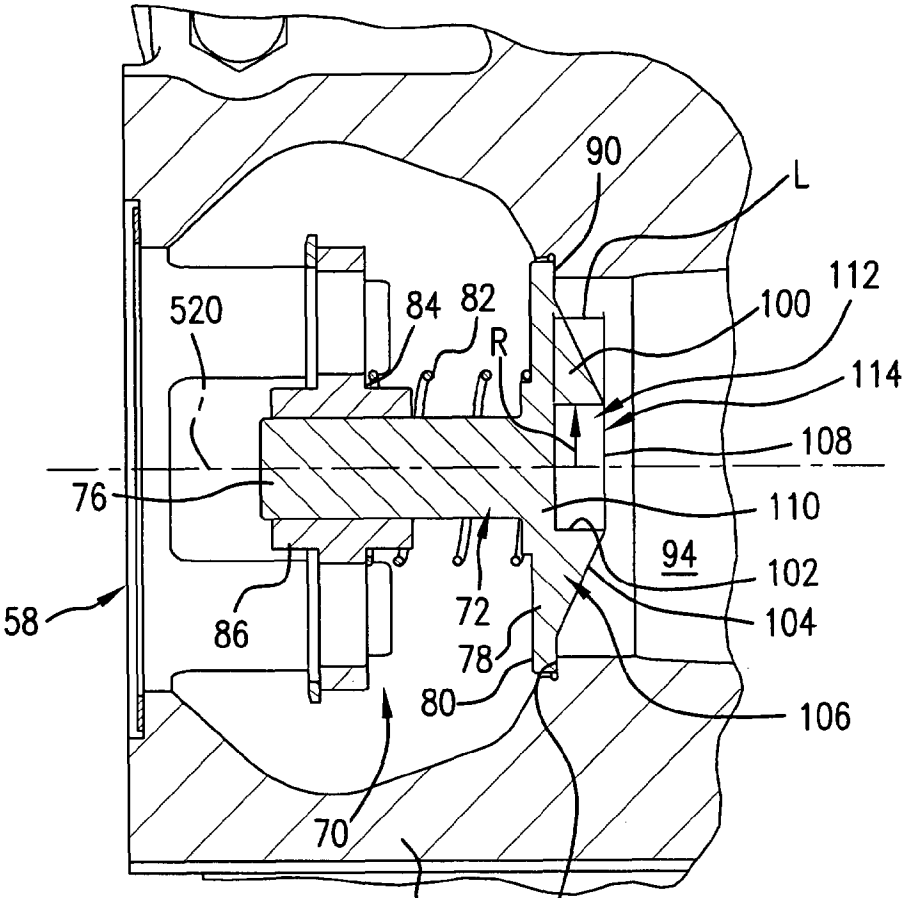
FIG. 3 is a partial sectional view of the discharge housing check valve of the compressor of FIG. 1 in a second condition.

FIG. 2 shows further details of the exemplary flowpath at the outlet/discharge port 58. A check valve 70 is provided having a valve element 72 mounted within a boss portion 74 of the outlet housing 56. The exemplary valve element 72 is a front sealing poppet having a stem/shaft 76 unitarily formed with and extending downstream from a head 78 along a valve axis 520. The head has a back/underside surface 80 engaging an upstream end of a compression bias spring 82 (e.g., a metallic coil). The downstream end of the spring engages an upstream-facing shoulder 84 of a bushing/guide 86. The bushing/guide 86 may be unitarily formed with or mounted relative to the housing and has a central bore 88 slidingly accommodating the stem for reciprocal movement between an open condition of FIG. 2 and a closed condition of FIG. 3. The spring 82 biases the element 72 upstream toward the closed condition. In the closed condition, an annular peripheral seating portion 90 of the head upstream surface seats against an annular seat 92 at a downstream end of a port 94 from the discharge plenum 62.

The opening and closing of the compression pockets at suction and discharge ports produce pressure pulsations. As the pulsations propagate into the gas in the discharge plenum and downstream thereof, they cause vibration and associated radiated sound which are undesirable. This pulsation may be at least partially addressed by modifications involving the check valve. Exemplary modifications involve modifications to the valve head to incorporate one or more resonators tuned to suppress/attenuate one or more sound/vibration frequencies. Exemplary modifications make use of existing manufacturing techniques and their artifacts. Exemplary modifications may be made in a remanufacturing of an existing compressor or a reengineering of an existing compressor configuration. An iterative optimization process may be used to tune the resonator(s).

FIG. 2 shows one exemplary modification of a basic valve element. This modification involves providing the head 78 with an upstream extending annular wall 100 inboard of the seating portion 90. The wall has inboard and outboard surfaces 102 and 104. The exemplary wall 100 extends upstream from a proximal downstream end 106 (joining a remaining portion of the head) to a distal upstream end formed by a rim 108. The surface 102 of the wall 100 and an upstream-facing surface 109 of a central web portion 110 of the head form a forwardly/upstream open blind compartment/cavity 112 having an upstream port/opening 114 encircled by the rim 108. Along the compartment 112, the inboard surface has an essentially constant radius R along a length L. The compartment 112 forms a side branch resonator. Geometric properties of the compartment 112 (e.g., the length and volume) may be tuned to suppress/attenuate one or more sound/vibration frequencies at one or more conditions. An exemplary frequency is that of the compression pockets opening/closing at the designed compressor operating speed and at the designed refrigeration system operating condition. Thus examples of otherwise identical compressors may feature differently-tuned resonators for use in different systems or conditions thereof. Exemplary modifications make use of existing manufacturing techniques and their artifacts. Exemplary modifications may be made in a remanufacturing of an existing compressor or a reengineering of an existing compressor configuration. An iterative optimization process may be used to tune the resonator(s).

Figure 4:
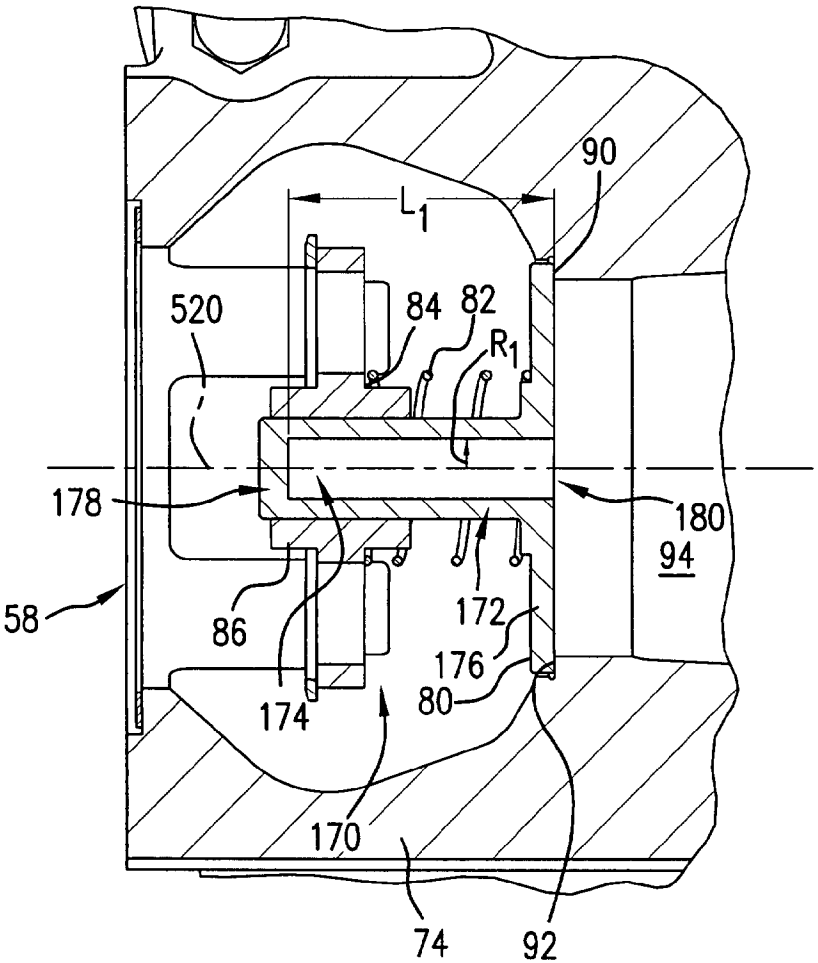
FIG. 4 is a partial sectional view of a second check valve.

FIG. 4 shows an alternate check valve 170 which may be generally similar to the check valve 70. Like features of these two valves are shown with like reference numerals. The valve 170 has a valve element 172 wherein the resonator blind compartment/cavity 174 extends downstream into the stem 178 from a port 180 in the head 176 and has a length $L_1$ and a radius $R_1$. These may, respectively be larger and smaller than corresponding parameters of the valve 70 if required to tune the resonator for a corresponding frequency.

Figure 5:
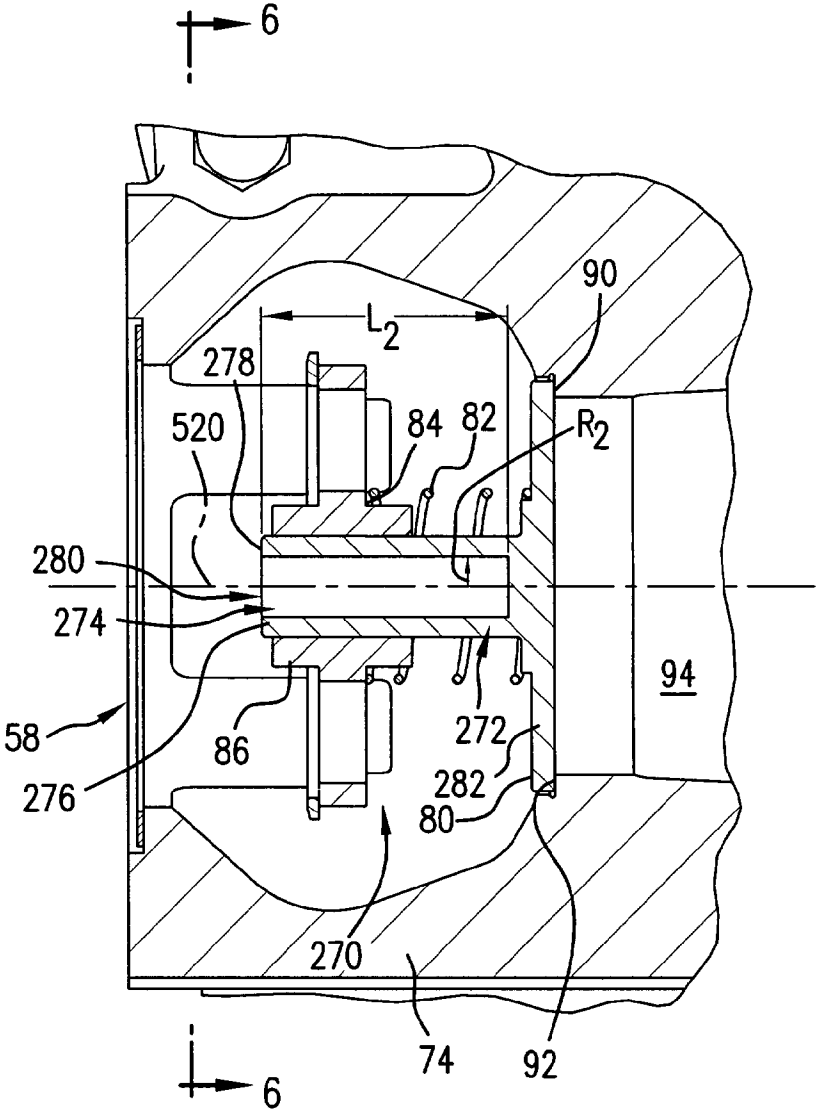
FIG. 5 is a partial sectional view of a third check valve.
Figure 6:
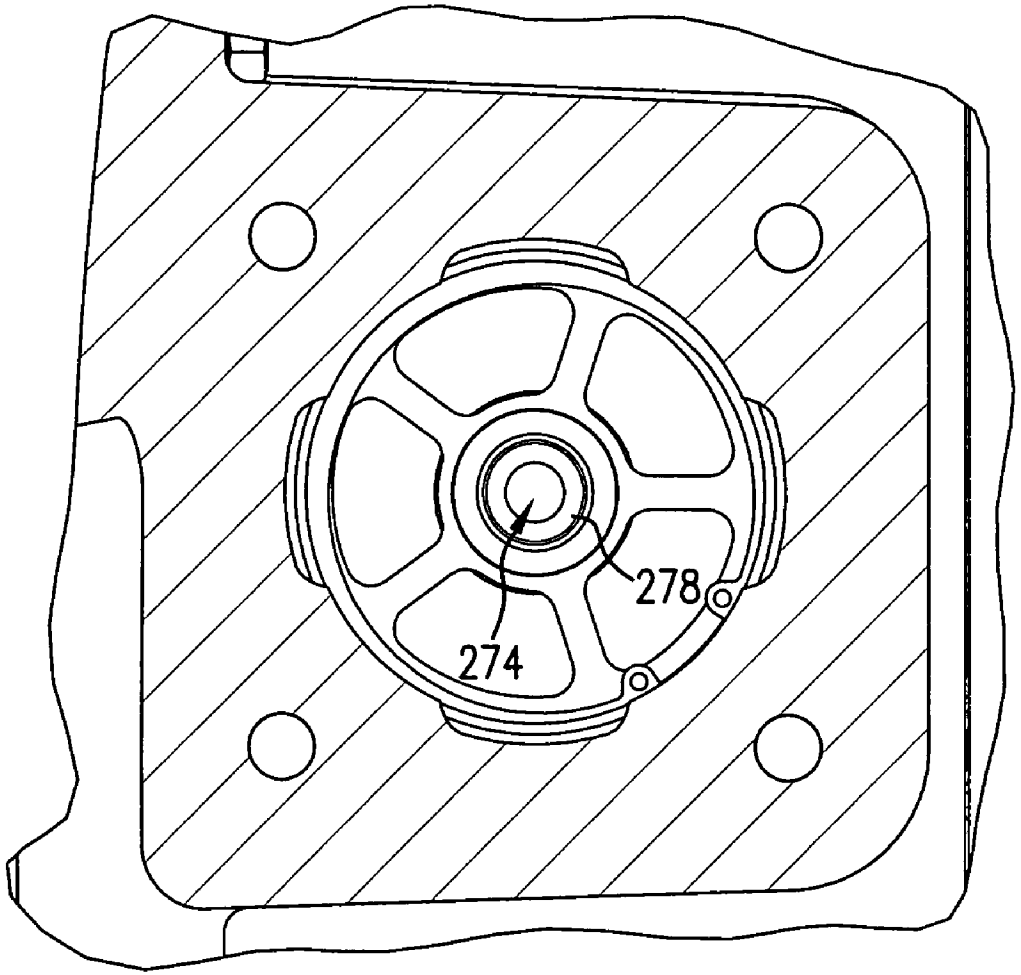
FIG. 6 is an end view of the check valve of FIG. 5.

FIGS. 5 and 6 show an alternate check valve 270 which may be generally similar to the check valves 70 and 170. Like features of these three valves are shown with like reference numerals. The valve 270 has a valve element 272 wherein the resonator compartment/cavity 274 extends upstream within the stem 276 from a port 280 at a stem downstream rim/end 278 toward the head 282 (and potentially into the head). The cavity has a length $L_2$ and a radius $R_2$. These may be similar to corresponding parameters of the valve 170.

The relative proximity of the resonator to the discharge plenum is believed advantageous for several reasons. First, the check valve is upstream of components like piping and oil separator that radiate sound due to internal pulsations. Locating a resonator in the check valve therefore cancels pulsations upstream of such components. Second, locating a resonator in the check valve is an effective use of space. Alternative locations might require adding additional material to housing walls.

Many known or yet-developed resonator configurations and optimization techniques may be applied. The former include, for example, Helmholtz resonators.

One or more embodiments of the present invention have been described. Nevertheless, it will be understood that various modifications may be made without departing from the spirit and scope of the invention. For example, in a reengineering or remanufacturing situation, details of the existing compressor may particularly influence or dictate details of the implementation. Implementations may involve check valves used in other locations in the fluid circuit. The principles may be applied to compressors having working elements other than screw-type rotors (e.g., reciprocating and scroll compressors). Accordingly, other embodiments are within the scope of the following claims.

What is claimed is:

1. A compressor apparatus (20) comprising:

a housing (22) having first (53) and second (58) ports along a flow path;

one or more working elements (26; 28) cooperating with the housing (22) to define a compression path between suction (60) and discharge (62) locations along the flow path; and a check valve (70; 170; 270) having a valve element (72; 172; 272) mounted for movement between a first condition permitting downstream flow along the flow path and a second condition blocking a reverse flow, wherein, the valve element includes a resonator (112; 174; 274).

2. The compressor of claim 1 wherein:

the check valve (70; 170; 270) is within the housing (22) immediately downstream of the discharge location (62).

3. The compressor of claim 1 wherein:

the valve element (72; 172) has an upstream head (78; 176) and a downstream stem (76; 178); and the resonator (112; 174) is at least partially within the head.

4. The compressor of claim 3 wherein:

the resonator (112; 174) has a port (114; 180) in an upstream face of the head (78; 176).

5. The compressor of claim 1 wherein:

the valve element (172; 272) has an upstream head (176; 282) and a downstream stem (178; 276); and the resonator (174; 274) is at least partially within the stem.

6. The compressor of claim 5 wherein:

the resonator (274) has a port (280) in a downstream end of the stem.

7. The compressor of claim 1 wherein:

the resonator (112; 174; 274) is a branch resonator.

8. The compressor of claim 1 wherein the one or more working elements include:

a male-lobed rotor (26) having a first rotational axis (500); and a female-lobed rotor (28) having a second rotational axis (502) and enmeshed with the male-lobed rotor.

9. The system of claim 7 wherein the branch resonator (112) is in a head (78) of the valve element.

10. The system of claim 7 wherein the branch resonator (274) is in a stem (276) of the valve element.

11. The apparatus of claim 1 wherein the compressor is a screw compressor.

12. A method for remanufacturing a compressor or reengineering a configuration of the compressor comprising:

providing an initial such compressor or configuration having:

a housing having a flow path between first and second ports;

a one or more working elements cooperating with the housing to define a compression path between suction and discharge locations along the flowpath; and a check valve along the flow path and having a valve element mounted for movement between a first condition permitting downstream flow along the flowpath and a second condition blocking a reverse flow; and selecting at least one geometric parameter of a resonator compartment in the valve element to provide a desired control of a pressure pulsation parameter.

13. The method of claim 12 wherein the selecting comprises an iterative:

varying of said at least one geometric parameter; and directly or indirectly determining the pressure pulsation parameter.

14. The method of claim 13 wherein:

the determining comprises measuring a sound intensity at a target frequency for pulsation.

15. The method of claim 12 wherein:

the initial such compressor or configuration lacks said compartment.

16. The method of claim 12 wherein:

the compressor is a screw compressor.

17. The compressor of claim 1 wherein the resonator is a blind compartment.

18. The compressor of claim 1 wherein the resonator has only a single port.

* * * * *